United States Patent [19]

Stinson et al.

[11] 3,986,570

[45] Oct. 19, 1976

[54] ROCK BIT WITH QUICK CHANGE CONNECTION

[75] Inventors: Leon B. Stinson; William Leroy Shepherd, both of Houston, Tex.

[73] Assignee: Hughes Tool Company, Houston, Tex.

[22] Filed: Aug. 11, 1975

[21] Appl. No.: 603,835

[52] U.S. Cl. ..... 175/320; 175/87; 175/394

[51] Int. Cl.[2] ..... E21B 17/00

[58] Field of Search ..... 175/320, 62, 334, 394, 175/335, 87, 331, 339, 327, 413; 64/1 R, 1 S; 279/20

[56] References Cited

UNITED STATES PATENTS

| | | | |
|---|---|---|---|
| 2,803,434 | 8/1957 | Heinish | 175/85 X |
| 2,838,282 | 6/1958 | Colquitt | 175/85 X |
| 2,887,301 | 5/1959 | Day | 175/339 X |
| 2,967,724 | 1/1961 | Adams | 175/320 X |
| 2,990,896 | 7/1961 | Kandle | 175/413 X |
| 3,024,856 | 3/1962 | Henning | 175/394 X |
| 3,092,190 | 6/1963 | Gruere | 299/55 X |
| 3,491,844 | 1/1970 | Kelly, Jr. | 175/413 X |
| 3,554,306 | 1/1971 | Wilburn | 175/320 |

*Primary Examiner*—Ernest R. Purser
*Assistant Examiner*—Richard E. Favreau
*Attorney, Agent, or Firm*—Robert A. Felsman

[57] ABSTRACT

Disclosed herein is a rock bit having a quick change connection for use with an auger drilling machine. The quick change connection comprises a female connection extending upwardly from the body of a conventional rock bit. The connection has polygonal sides that mate with matching surfaces of a male connection secured to a kelly. A pin extends through mating holes in the female and male connections for fastening. Thus the male connection is axially releasable from the female connection by removing the pin. This permits convenient change between the auger drilling system and the rock bit drilling system.

3 Claims, 6 Drawing Figures

ROCK BIT WITH QUICK CHANGE CONNECTION

BACKGROUND OF THE INVENTION

1. Field of the Invention

This invention relates in general to earth boring bits, and in particular to a rock bit having a quick change connection for use with an auger drilling machine.

2. Description of the Prior Art

Earth boring bits of the rolling cutter rock bit type are most frequently used for relatively deep small diameter holes. Conventional bits typically contain male threads for connection to the drill stem. A circulating fluid is pumped through the bit to wash cuttings from the borehole to the surface. The rotary rock bit drilling system combines the drilling and cuttings removal function into a continuous operation in which the drilling and cuttings removal by means of fluid circulation occur simultaneously and continuously.

Auger drilling machines normally are used for drilling relatively large diameter shallow holes for foundations, piers, and the like and conventionally use a helical flighted auger. Often the auger is supplemented by pilot bits attached to the bottom end. The auger normally has a square female box connection which connects to the bottom of a kelly. The female connection has no threads, is pinned to the kelly, and is axially releaseable. A circulation fluid is generally unnecessary since cuttings are collected on the auger, which is occassionally raised to the surface for dumping the cuttings. Thus, auger drilling is an intermittent, cyclical drilling system in which the drilling function is completely separated from the cuttings removal function, which is purely mechanical.

At times, for hard rock drilling, it is desirable to replace the auger with a rock bit while utilizing the same auger drilling machine. Since conventional rock bits contain a threaded male pin, a matching threaded female box had to be attached to the bottom of the kelly. The box was hollow so that fluid could be pumped through the bit to prevent packing of the cutter teeth with cuttings. The threaded coupling also requires the use of a break-out apparatus which is a cumbersome addition to an auger drilling machine.

SUMMARY OF THE INVENTION

It is accordingly an object of this invention to provide apparatus enabling convenient change between the rotary rock bit drilling system and the auger drilling system.

Another object of this invention is to provide an improved rock bit for use with an auger drilling machine.

Another object is to provide a rock bit with an improved connection for use with an auger drilling machine that allows fast interchange with an auger, permits fluid circulation for cleaning the rock bit and removing cuttings from the hole, and does not require a break-out apparatus.

Another object is to provide auger drilling apparatus with a kelly having a depending male connector with polygonal sides, a rock bit with a female connector having polygonal sides and a pin to releasably secure either a rock bit or an auger to the apparatus.

Additional objects, feature and advantages of the invention will become more fully apparent in view of the following description.

DESCRIPTION OF THE PREFERRED EMBODIMENT

Figure 2:
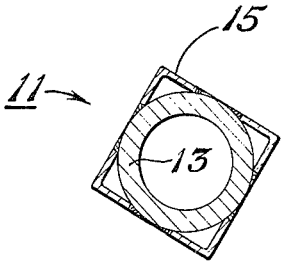
FIG. 2 is a transverse cross sectional view of the kelly of FIG. 1.
Figure 1:
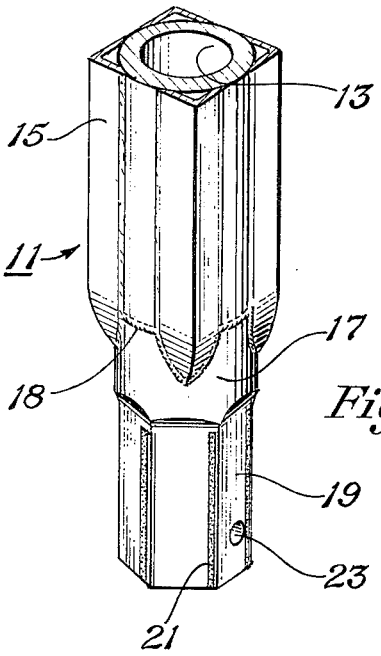
FIG. 1 is a fragmentary perspective view of a drive shaft or kelly for use with an auger drilling machine.

A drive shaft or kelly 11 for use with an auger drilling machine is shown in FIGS. 1 and 2. Kelly 11 comprises a hollow pipe 13 to which angle iron strips 15 have been welded to give kelly 11 a square exterior as seen in a transverse cross section.

Figure 4:
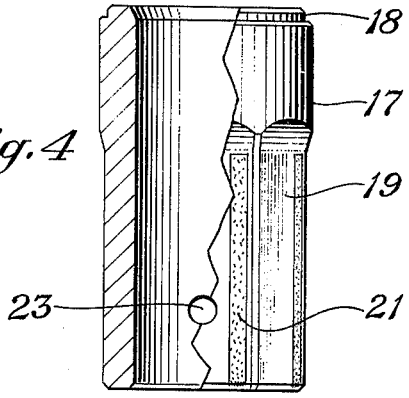
FIG. 4 is an elevational view, partially in section, of the male connection of the kelly of FIG. 1.

A male connection 17, shown in FIGS. 1 and 4, is welded as at numeral 18 to the bottom of pipe 13, forming a part of kelly 11. If kelly 11 is adapted for circulation drilling, male connection 17 is hollow, as shown in the drawing. The lower external wall of male connection 17 is polygonal. Sides 19 of the polygon are evenly spaced and preferably have hardfacing 21 on the leading or driving edge to resist wear.

Figure 5:
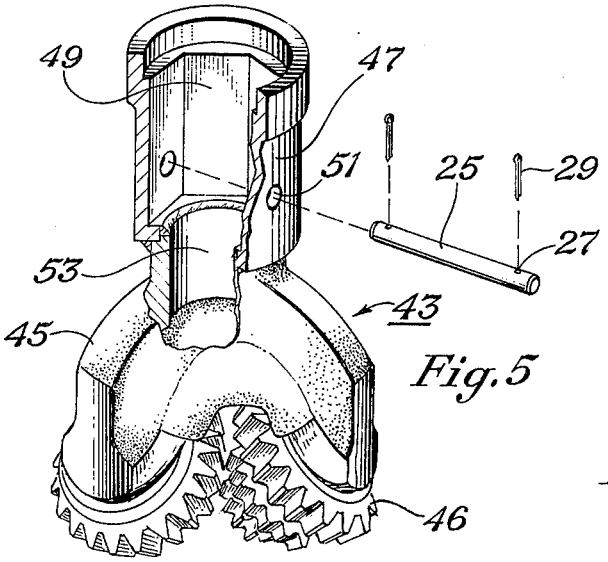
FIG. 5 is a perspective view, partially in section, of a rock bit constructed in accordance with the principle of the invention.

A pair of holes 23 extend through opposing polygonal sides 19 of male connection 17 and are aligned for the insertion of a pin 25 as shown in FIG. 5. Pin 25 is a smooth cylindrical rod to be assembled within holes 23. Small holes 27 are drilled transversely through each end of pin 25 for the insertion of cotter pins 29.

Figure 3:
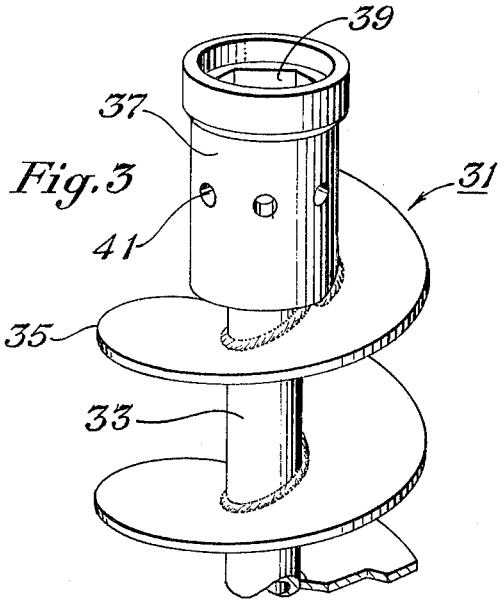
FIG. 3 is a fragmentary perspective view of an auger.

An auger 31 is shown in FIG. 3 having a shaft 33 to which a helical flight 35 is welded. A female box connection 37 is welded to the top of shaft 33. Female connection 37 has a polygonally shaped inner wall. Sides 39 of the polygonal wall are evenly spaced and are sized to assemble closely over sides 19 of male connection 17. A plurality of holes 41 extend tranversely through the opposing polygonal wall surfaces of the female connection 37 and are spaced to align with holes 23 of the male connection 17.

Figure 6:
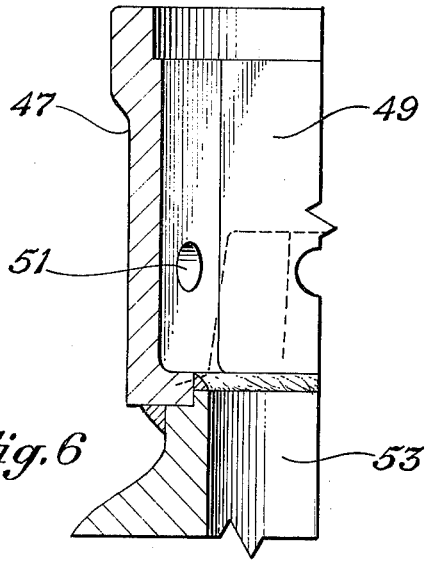
FIG. 6 is a fragmentary vertical sectional view of the rock bit of FIG. 5.

A typical rolling cutter rock bit 43 is shown in FIGS. 5 and 6. Rock bit 43 comprises a body formed of three head sections 45, each having a bearing pin (not shown) cantilevered from the bottom end. Toothed cutters 46 are journaled on each bearing pin. A female box connection 47 upwardly depends from the junction of the head sections 45. Female connection 47 is identical to female connection 37 of auger 31, having a polygonal interior or inner wall. Sides 49 of the polygon are adapted to mate and drive against sides 19 of the male connection 17. Holes 51 within the walls of female connection 47 are spaced to align with holes 23 of the male connection 17. A passage 53 extends axially through rock bit 43 for the passage of drilling fluid.

In operation drive means rotates kelly 11 by means of a square kelly bushing (not shown) that allows the kelly to travel axially during rotation.

If it is desired to use the auger, auger 31 is inserted over male connection 17 with holes 23 in alignment with holes 41. Pin 25 is inserted transversely in holes 23 and 41, and cotter pins 29 are inserted in holes 27. Sides 19 transmit torque from the rotation forces through sides 39. No fluid will be circulated, the cuttings from the earth being brought to the surface by the auger flight 35.

If it becomes advantageous to exchange the auger for a rock bit, cotter pins 29 are removed and pin 25 punched loose from holes 41 and 23. Auger 31 is withdrawn and rock bit 43 inserted over male connection 17. After alignment of holes 23 with holes 51, pin 25 is inserted and fastened by cotter pins 29. Pump means supplies fluid down kelly 11 and passage 53, returning cuttings up the hole being drilled.

When it is desired to remove the rock bit, pin 25 is removed and the bit moved axially downward without rotation. Holes 23 and 51 in conjunction with pin 25 serve as means for fastening the rock bit to the drive shaft or kelly 11.

It should be apparent that an invention having significant advantages has been provided. An improved rock bit for use with an auger drilling machine has been provided that allows for fast interchange with an auger. Construction is simple and a break-out apparatus is unnecessary.

While the invention has been shown in only one form, it should be obvious to those skilled in the art that it is not so limited, but is susceptible of various changes and modifications without departing from the spirit thereof.

We claim:

1. An improved rock bit for use with an auger drilling machine, said bit comprising:

a body having three depending head sections;

bearing means cantilevered from each head section rolling cutter means carried by each of the bearing means;

fluid passage means extending through said body;

a connector secured to the body and having a depression, polygonal in cross section to form walls, containing apertures adapted to receive fastener means.

2. Improved auger drilling means including convenient interchange of an auger and rock bit on a hollow kelly, said means comprising:

a hollow male connector having one end adapted for attachment to the kelly, polygonal walls, and a pair of transverse holes therethrough;

a rock bit having a body with a fluid passage therethrough and with three depending head sections having cantilevered bearing means;

rolling cutter means secured to each of the bearing means;

a female connector secured to said body and having a depression, polygonal in cross section, to form walls containing transverse holes for alignment with the holes of the male connector;

fastener means to extend through the holes of the male and female connectors.

3. Improved earth boring means comprising:

a drilling machine;

kelly means adapted for rotation and raising or lowering by the drilling machine;

a hollow male connector with polygonal walls and transverse holes therethrough;

a rock bit having a body with a fluid passage therethrough and with three depending head sections having cantilevered bearing means;

rolling cutter means secured to the bearing means;

a female connector secured to said body and having a depression, polygonal in cross section, to form walls containing transverse holes for alignment with holes of the male connector;

fastener means to extend through the holes of the male and female connectors.

* * * * *